US006516980B1

(12) United States Patent
Goldman

(10) Patent No.: US 6,516,980 B1
(45) Date of Patent: Feb. 11, 2003

(54) CLIP ARRANGEMENT FOR GARMENT HANGERS

(75) Inventor: Allan Joel Goldman, Wayne, NJ (US)

(73) Assignee: Uniplast Industries, Inc., Hasbrouck Heights, NJ (US)

( * ) Notice: Subject to any disclaimer, the term of this patent is extended or adjusted under 35 U.S.C. 154(b) by 0 days.

(21) Appl. No.: 09/962,433

(22) Filed: Sep. 24, 2001

(51) Int. Cl.[7] ..... A41D 27/22

(52) U.S. Cl. ..... 223/85; 223/90; 223/91; 223/93; 223/96

(58) Field of Search ..... 223/85, 93, 96, 223/90, 91

(56) References Cited

U.S. PATENT DOCUMENTS

| | | | | |
|---|---|---|---|---|
| 4,623,079 A | * 11/1986 | Tendrup et al. | ..... | 223/85 |
| 4,892,237 A | 1/1990 | Duester et al. | ..... | 223/85 |
| 5,062,556 A | 11/1991 | Willpütz | ..... | 223/96 |
| 5,065,916 A | 11/1991 | Fildan | ..... | 223/91 |
| 5,411,189 A | 5/1995 | Gouldson | ..... | 223/85 |
| 5,509,587 A | 4/1996 | Gouldson et al. | ..... | 223/91 |
| 5,516,013 A | 5/1996 | Gouldson et al. | ..... | 223/91 |
| 5,573,151 A | 11/1996 | Fildan | ..... | 223/96 |
| 5,778,575 A | 7/1998 | Deupree et al. | ..... | 40/322 |
| 6,196,430 B1 | 3/2001 | Gouldson | ..... | 223/96 |
| D453,423 S | 2/2002 | Goldman et al. | | |

* cited by examiner

*Primary Examiner*—John J. Calvert
*Assistant Examiner*—James G Smith
(74) *Attorney, Agent, or Firm*—Darby & Darby

(57) ABSTRACT

A garment hanger is provided and includes an elongated body, an integrally formed, centrally located hook member, and clip assemblies located at each opposing end of the body. Each clip assembly includes a horizontal lower clip, a horizontal upper clip and a vertical end clip. Each vertical clip includes a downwardly directed anchor arm which is spaced a predetermined distance from an inner surface of the end of the hanger and defines a receiving slot therebetween, into which clothing may be selectively inserted. The inner surface of the receiving slot includes an integrally formed upwardly and outwardly directly spring arm which is spring biased against an inside contact surface of the rigid anchor arm. It is the resiliency of this spring arm that creates a clamping action within the receiving slot which is used to force any inserted clothing snugly against the anchor arm, thereby holding the clothing in place within the receiving slot. The resiliency also permits the spring arm to flex inwardly toward the hanger body during garment insertion.

25 Claims, 5 Drawing Sheets

CLIP ARRANGEMENT FOR GARMENT HANGERS

BACKGROUND OF THE INVENTION

1. Field of the Invention

The present invention relates generally to molded plastic hangers which are commonly used to ship and display lightweight clothing, such as undergarments, e.g., underwear, bathing suits, brasiers, etc. Garment hangers of this type typically include an elongated hanger body, a hook, and at least one clip located at each end of the elongated body. This invention relates more particularly to a clip structure used to hold one or more garments to the hanger body.

2. Description of the Prior Art

There have been many different types of plastic garment hangers used to hold lightweight garments. U.S. Pat. No. 6,196,430 to Gouldson discloses a plastic garment hanger which has an elongated body, an integrally formed hook, and two opposing integrally formed clip assemblies located at each end of the body. Each clip assembly includes a horizontal lower clip, a horizontal upper clip and a vertical end clip. The horizontal lower and upper clips have a similar structure including an outwardly secured arm that extends inwardly towards the hook of the hanger, at a slight angle which directs the arm towards the body of the hanger. Each arm then reverses upon itself forming a contact portion which extends towards the respective end of the hanger body and also generally parallel and very close to an edge of the body (either the upper edge or a lower edge, depending on the horizontal clip). The contact portion and the arm portion of each horizontal clip creates a resilient spring bias which effectively pushes the contact portion evenly towards the respective edge of the hanger body. A portion of the clothing may be inserted between the contact portion and the edge of the hanger body against the spring bias of the contact portion so that the clothing becomes pinched or clamped to the hanger body.

The clip assembly of the hanger of U.S. Pat. No. 6,196,430 also includes a vertical clip that includes an outwardly and downwardly directed spring arm which defines a receiving slot between each respective end of the hanger body. The spring arm reverses upon itself to define an upwardly and inwardly directed contact portion which is located within the receiving slot. Each contact portion is spring biased generally against each respective end of each respective end of the hanger's body so that any clothing that is inserted into either respective receiving slot will become pinched or otherwise clamping into the receiving slot by the spring bias of the contact portion forcing the clothing against the respective end of the hanger's body. The inner side of the receiving slot (that side which opposes the contact portion of the spring arm) of the hanger of U.S. Pat. No. 6,196,430 is rigid and provides an anchor surface against which the contact portion of the spring arm can push any clothing that is inserted into the receiving slot.

U.S. Pat. No. 4,892,237 to Duester et al.; U.S. Pat. No. 5,062,556 of Willputz; U.S. Pat. No. 5,065,916 to Fildan; U.S. Pat. No. 5,411,189 to Gouldson; U.S. Pat. No. 5,573,151 to Fildan; U.S. Pat. No. 5,516,013 to Gouldson et al.; U.S. Pat. No. 5,509,587 to Gouldson et al.; U.S. Pat. No. 5,778,575 to Deupree et al. all disclose similar plastic garment hangers that have similar clip structure to the clip assembly used in above-described U.S. Pat. No. 6,196,430 to Gouldson. More particularly, each of patents disclose a garment hanger for holding lightweight clothing and which includes at least one vertical clip. Each of these vertical clips includes outwardly and downwardly directed spring arms that provide a spring bias (either directly or with the aid of an integrally formed upwardly and inwardly directed contact portion) and a clamping action across a clothing receiving slot. In each case of the above-listed prior art patents, the opposing (inner—closest to the hook portion of the hanger) side of the receiving slot of each garment hanger provides a rigid anchor surface against which the clothing may be pressed against (by the biased spring arm). The opposing (inner) side of the receiving slot of these prior art hangers are not flexible, but are rigid in structure.

SUMMARY

A garment hanger is provided and includes an elongated body, an integrally formed, centrally located hook member, and clip assemblies located at each opposing end of the body. Each clip assembly includes a horizontal lower clip, a horizontal upper clip and a vertical end clip. The horizontal lower and upper clips have a similar structure to each other, including an outwardly secured arm that extends inwardly towards the hook member of the hanger at a slight angle which directs the arm towards the body of the hanger. Each arm then reverses upon itself forming a contact portion which extends towards the respective end of the hanger body and also generally parallel and very close to an edge of the body (either the upper edge or a lower edge, depending on the horizontal clip). The contact portion and the arm portion of each horizontal clip creates a resilient spring bias which effectively pushes the contact portion evenly towards the respective edge of the hanger body. A portion of the clothing may be inserted between the contact portion and the edge of the hanger body against the spring bias of the contact portion so that the clothing becomes pinched or clamped to the hanger body.

The clip assembly at each end of the present hanger further includes a vertical clip. Each vertical clip includes a reinforced, somewhat rigid downwardly directed anchor arm which is spaced a predetermined distance from an inner surface of the end of the hanger and defines a receiving slot therebetween, into which clothing may be selectively inserted. The inner surface of the receiving slot includes an integrally formed upwardly and outwardly directly spring arm which is spring biased against an inside contact surface of the rigid anchor arm. It is the resiliency of this spring arm that creates a clamping action within the receiving slot which is used to force any inserted clothing snugly against the anchor arm, thereby holding the clothing in place within the receiving slot.

BRIEF DESCRIPTION OF THE DRAWINGS

The foregoing objects and advantages of the present invention may be more readily understood by one skilled in the art with reference being had to the following detailed description of a preferred embodiment thereof, taken in conjunction with the accompanying drawings wherein like elements are designated by identical reference numerals throughout the several views, and in which.

DETAILED DESCRIPTION OF A PREFERRED EMBODIMENT OF THE INVENTION

Figure 1:
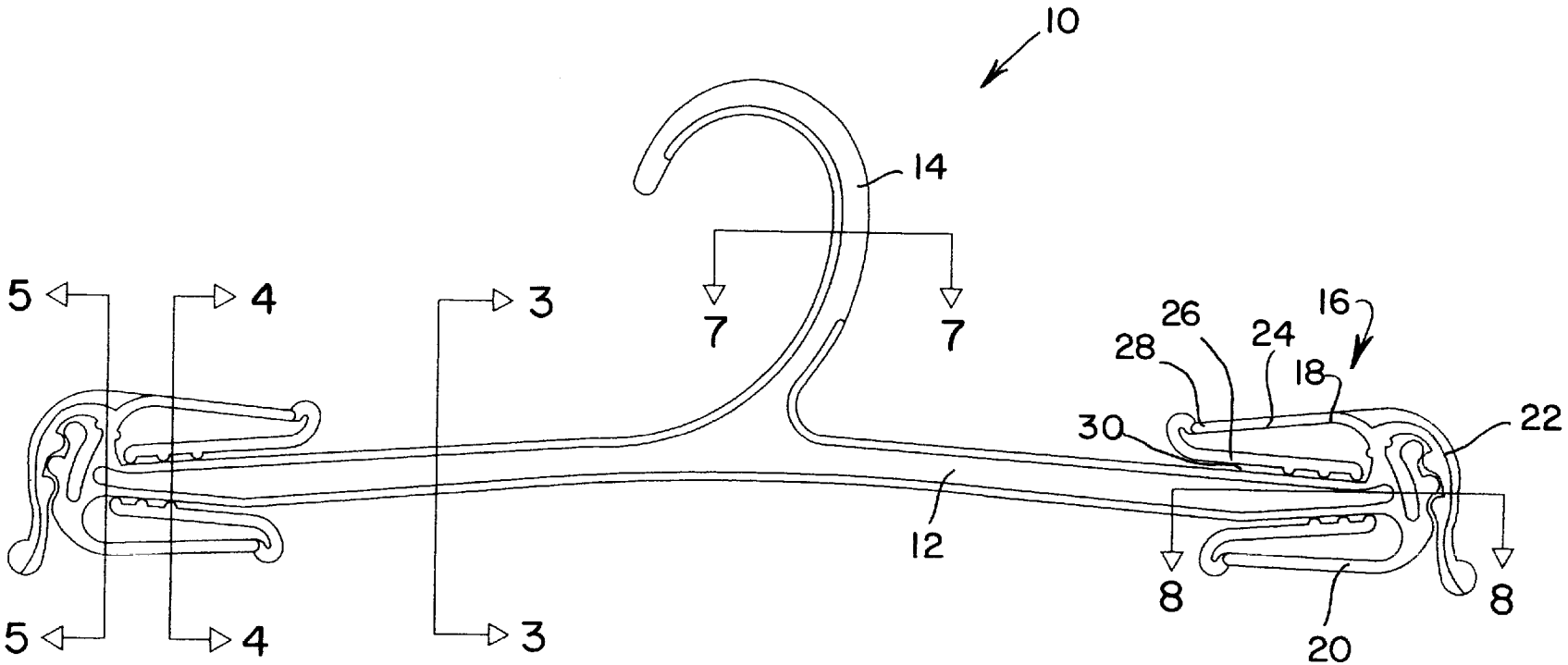
FIG. 1 is a plan front view of a garment shipping hanger according to one embodiment.

Referring to FIGS. 1 through 11, a garment shipping hanger 10, according to one embodiment, is shown. Garment hanger 10 includes a body portion 12 having two opposing ends and a hook member 14 integrally molded to body portion 12. The hook member 14 is generally positioned at a midpoint along body portion 12. The hanger 10 includes a clip assembly 16 integrally molded to body portion 12 and located at each opposing end of body portion 12. Garment shipping hanger 10 is preferably made as a single piece, molded in plastic using a plastic injection molding machine, as is understood by those skilled in the art. Any appropriate plastic may be used, such as styrene, which provides a clear, virtually transparent hanger. Alternatively, the hanger may be molded using polypropylene, such as H.I. styrene polypropylene, polypropylene, polyvinyichloride, ABS or other suitable thermoplastics and/or mixtures thereof. As understood by those skilled in the art, the plastic mixture used to mold the hangers may include additional resins for added strength and reinforcement.

Figure 2:
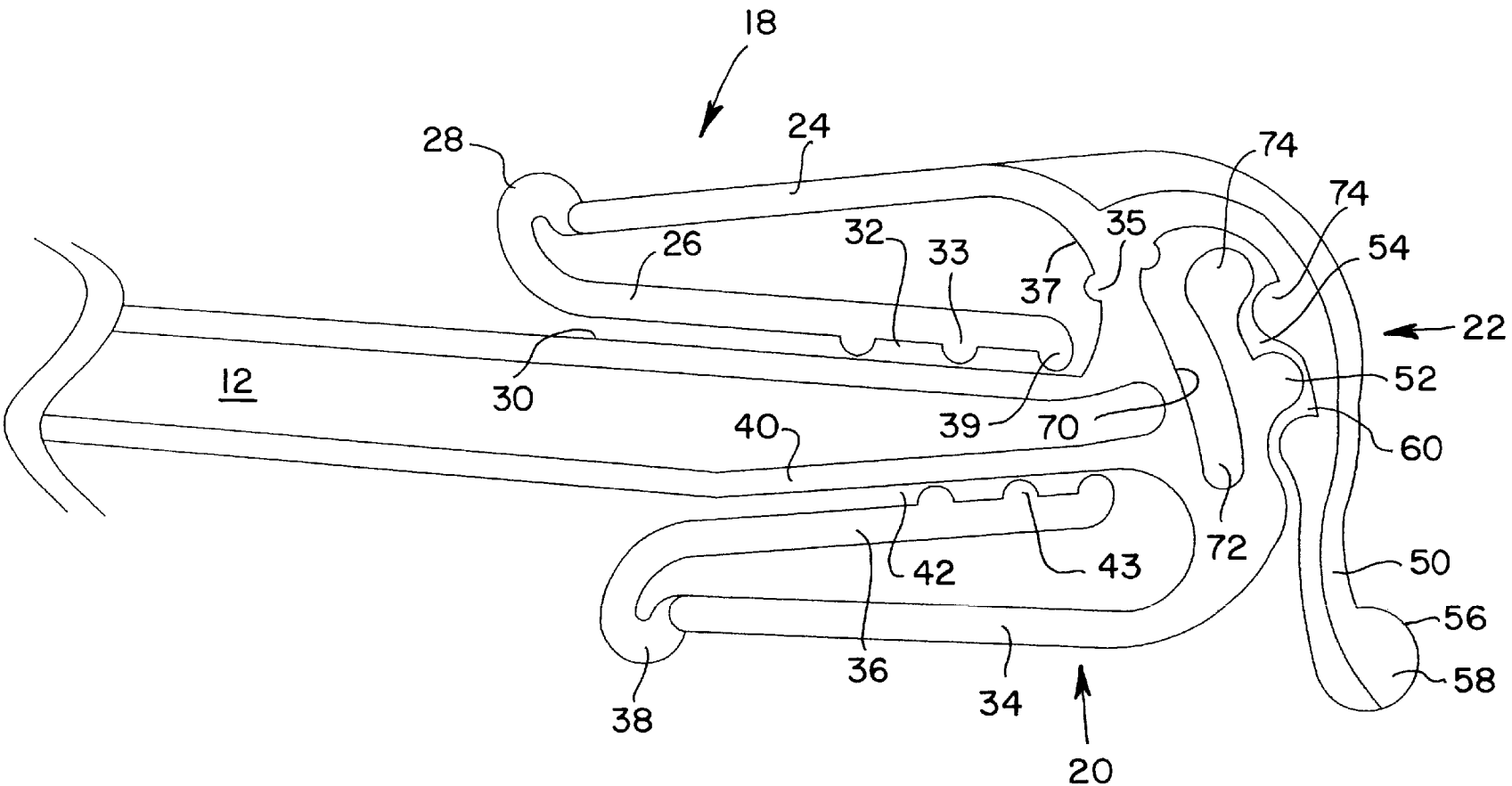
FIG. 2 is an enlarged view of a clip assembly showing details of an upper horizontal clip, a lower horizontal clip, and a vertical clip according to one embodiment.
Figure 3:
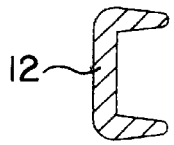
FIG. 3 is an enlarged cross-sectional view of the body portion taken along the line 3—3 of FIG. 1.
Figure 7:
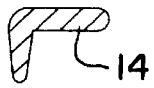
FIG. 7 is an enlarged cross-sectional view of a hook member of the garment hanger taken along the line 7—7 of FIG. 1.
Figure 4:
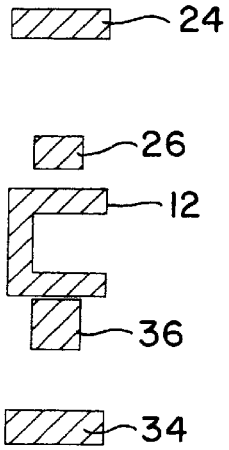
FIG. 4 is an enlarged cross-sectional view of a clip assembly of the garment hanger taken along the line 4—4 of FIG. 1.
Figure 5:
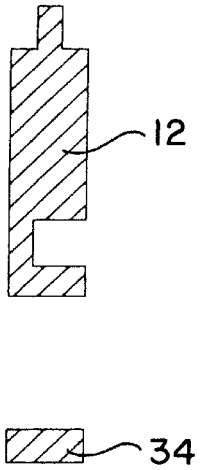
FIG. 5 is an enlarged cross-sectional view of the clip assembly of the garment hanger taken along the line 5—5 of FIG. 1.
Figure 6:
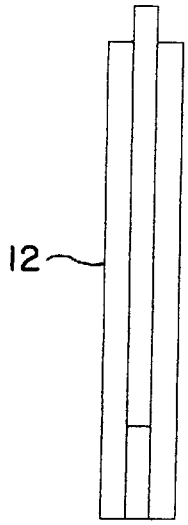
FIG. 6 is a side view of the clip assembly.
Figure 8:
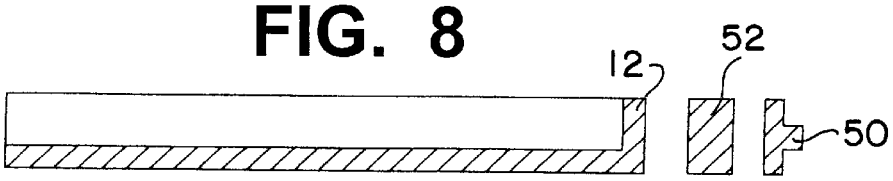
FIG. 8 is an enlarged cross-sectional view of the clip assembly taken along the line 8—8 of FIG. 1.
Figure 9:
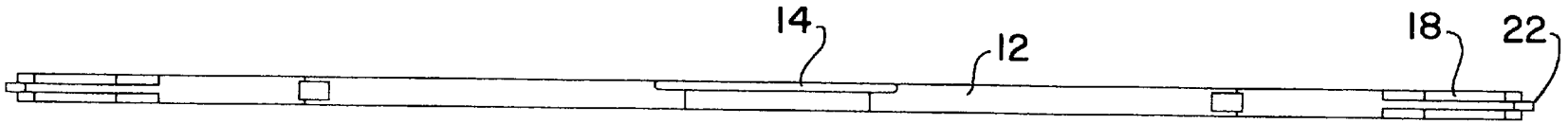
FIG. 9 is a top view of the entire garment hanger of FIG. 1.
Figure 10:
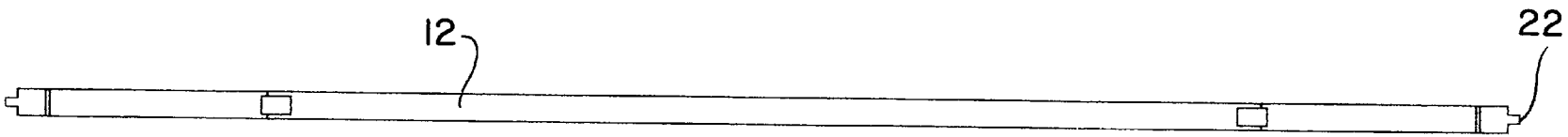
FIG. 10 is a bottom view of the entire garment hanger of FIG. 1.
Figure 11:
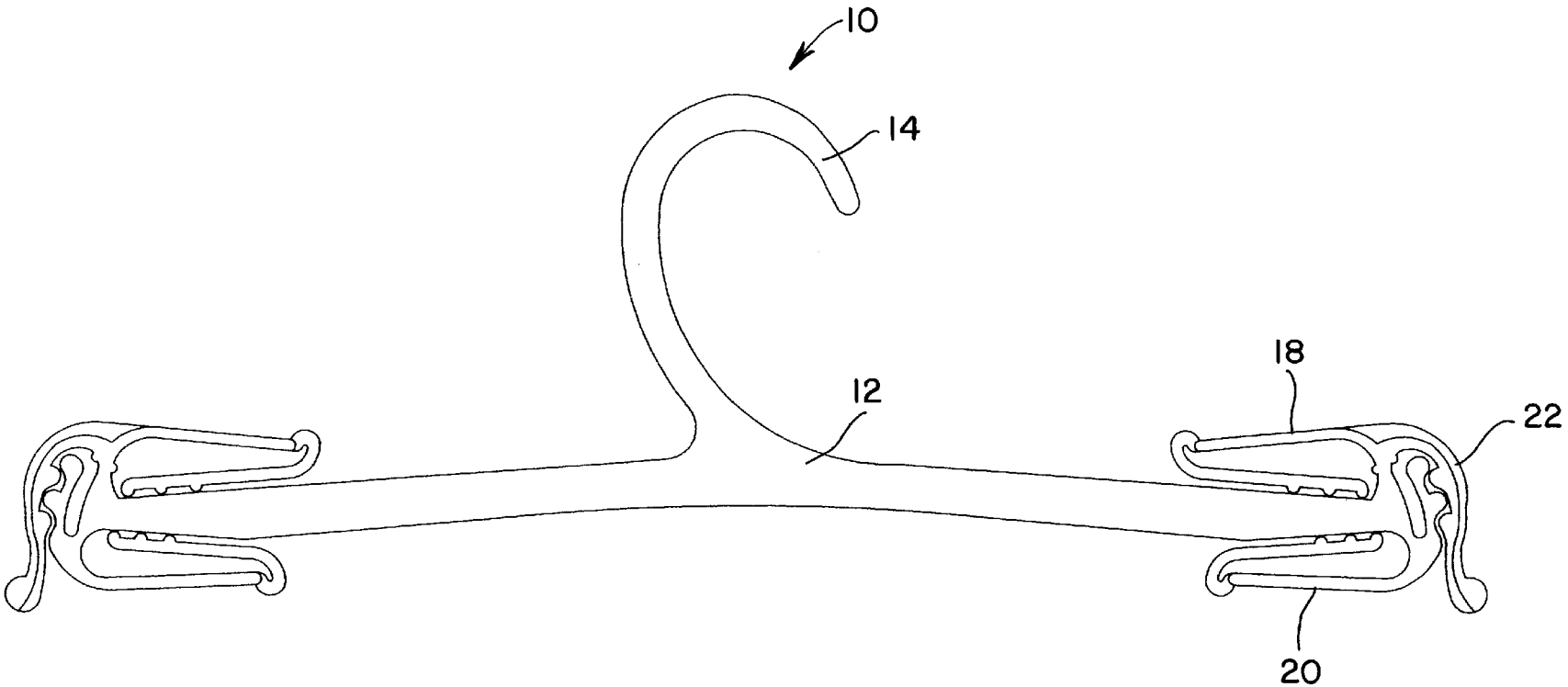
FIG. 11 is a rear plan view of the garment hanger of FIG. 1.

According to one exemplary embodiment of the invention and referring to FIGS. 1 and 2, each clip assembly 16 includes an upper horizontal clip 18, a lower horizontal clip 20, and an outer vertical clip 22. Of course, other clip arrangements can be provided, as long as the clip assembly includes at least vertical clip 22. As shown in FIG. 2, upper horizontal clip 18 includes a support arm portion 24, which extends generally from its respective clip assembly 16 towards hook portion 14, an integrally attached spring arm 26, which extends outwardly from the innermost (closest to the hook portion) end 28 of support arm portion 24 towards the respective clip assembly 16 and the respective end of the hanger body 12. Spring arm 26 is molded to support arm portion 24 so that it lies generally parallel and adjacent to an upper edge 30 of hanger body 12, as shown in FIG. 2, thereby creating an upper garment-receiving slot 32. It will be appreciated that a portion, e.g., a distal end, of spring arm 26 may contact upper edge 30.

Spring arm 26 is molded in a "rest" position, as shown in FIG. 2, so that the natural resiliency of its structure and composition will resist movement from this rest position and create a spring bias against any such movement. It is this spring bias force of spring arm 26 that creates the desired clamping action used to hold a garment to the hanger 10. To help hold an inserted garment within upper garment-receiving slot 32, spring arm 26 and/or upper edge 30 may have ridges or molded dimples 33 formed thereon. End 28 is preferably rounded upwardly to help receive a garment portion and guide it into slot 32.

A ridge or molded dimple 35 may also be formed on edge 37 of clip assembly 16. This dimple 35 is spaced slightly from a distal end 39 of spring arm 26. It provides an additional raised surface that assists in holding the garment. It will also be appreciated that the ridges or dimples 33 may be provided on spring arm 26 and upper edge 30 in an alternating manner so that they intermesh with one another when spring arm 26 is naturally biased against edge 30 or when a garment is disposed in slot 32.

In operation of upper horizontal clip 18, as a portion of a garment (not shown) is inserted within upper garment-receiving slot 32, between upper edge 30 of body 12 and spring arm 26, spring arm 26 will flex upwardly away from upper edge 30 to accommodate the thickness of the inserted garment portion. Since spring arm 26 is formed as a resilient member so that as the garment is inserted, spring arm 26 will move upwardly against its spring bias and will thereby clamp to and hold (secure) the inserted garment portion to the hanger body 12, as is generally understood by those skilled in the art.

Similar to the above-described upper horizontal clip 18, lower horizontal clip 20 includes a support arm portion 34 and an integrally attached spring arm 36. Support arm 34 extends generally from its respective clip assembly 16 towards hook member 14. Spring arm 36 extends outwardly from the innermost (closest to the hook member) end 38 of support arm portion 34 towards the respective clip assembly 16 and the respective end of the hanger body 12. Spring arm 36 is molded to support arm portion 34 so that it lies generally parallel and adjacent to a lower edge 40 of hanger body 12, as shown in FIG. 2, thereby creating a lower garment-receiving slot 42. Spring arm 36 is molded in a "rest" position, as shown in FIG. 2, so that the natural resiliency of its structure and composition will resist movement from this rest position and create a spring bias against any such movement. It is this spring bias force of spring arm 36 that creates the desired clamping action used to hold a garment to the hanger 10. To help hold an inserted garment within lower garment-receiving slot 42, spring arm 36 and/or lower edge 40 may have ridges or molded dimples 43 formed thereon. End 38 is preferably rounded upwardly to help receive a garment portion and guide it into slot 42.

In operation of lower horizontal clip 20, as a portion of a garment (not shown) is inserted within lower garment-receiving slot 42, between upper edge 40 of body 12 and spring arm 36, spring arm 36 will flex downwardly away from upper edge 40 to accommodate the thickness of the inserted garment portion. As with spring arm 26, spring arm 36 moves downwardly against its spring bias as the garment is inserted and will thereby clamp to and hold the inserted garment to the hanger body 12 due to its resilient nature and spring bias.

In another aspect, each clip assembly 16 includes a vertical clip 22, which has a downwardly directed outer anchor arm 50, an upwardly directed inner spring arm 52, and an interposed vertically disposed garment-receiving slot 54. Outer anchor arm 50 includes an outer surface 56 having a rigid-reinforcement ridge 58 and an inner gripping surface 60. Spring arm 52 is integrally formed with clip assembly 16 at a "rest" position located generally parallel and adjacent to an edge 70 of the body 12. Edge 70 is integrally formed as part of each clip assembly 16 and extends between upper horizontal clip 18 and lower horizontal clip 20. A space or channel 72 is formed between edge 70 and spring arm 52. Channel 72 permits spring arm 52 to flex inwardly as a garment is inserted in to slot 54 so as to accommodate the thickness of the garment and the bias action of the spring arm 52 towards the outer anchor arm 50 causes the garment to be securely held within the slot 54. As with upper and lower horizontal clips 18, 20, outer vertical clip 22 preferably includes ridges or dimples which aid in the holding of a garment disposed within slot 54. More specifically, spring arm 52 may have one or more ridges or dimples 74 formed thereon and outer anchor arm 50 may also have one or more ridges or dimples 74 formed thereon to aid in holding the garment placed in the slot 54. The ridges or dimples 74 should be complementary to one another and therefore, in one exemplary embodiment, the ridges or dimples 74 are formed in an intermeshing manner such that in the normal rest position or when a garment is held in the slot 54, the ridges or dimples 74 intermesh with one another.

The hanger 10 provides a multi-purpose clip assembly at the ends of the hanger body 12. Each clip assembly 16 not only provides an upper garment receiving slot 32 and a lower garment receiving slot 42 but also a vertical garment receiving slot 54 at the end of the body 12. This multi-arm clip configuration permits the user to hang one or more garments in a desired location and in a location that best fits the particular type of garment that the user is attempting the hang. For example, heavier items may be better suited for hanging using lower horizontal clip 20 instead of vertical clip 22 which opens downward. Hanger 10 is configured to accommodate a wide range of garment types, sizes, and weights due to the multi-clip assemblies at both ends. Unlike conventional designs, the hanger 10 provides an end clip which has an inner contact surface (the spring arm 52) which is resilient rather than being formed of a rigid member. Because of its resiliency, the spring arm 52 is free to flex inwardly toward the hanger body to accommodate the thickness of the garment; however, its spring biased force in the opposite direction ensures that the garment is securely held between the resilient spring arm 52 and the outer anchor arm 50. The resiliency of-the spring arm 52 permits vertical end clip 22 to accommodate a greater variety of garments in comparison with the previously-discussed conventional hangers in which the rigid vertical surfaces of the end clips impose limitations on how much the clip portion may be opened. In particular, the vertical clip 22 is formed of two members (outer anchor arm 50 and spring arm 52) that are each flexible and each has a degree of motion. By forming the vertical clip 22 of two flexible members, the vertical clip 22 accommodates garments having a wider range of thicknesses than conventional hangers.

While there have been shown and described what are considered to be the preferred embodiments of the invention, it will, of course, be understood that various modifications and changes in form or detail can be readily made without departing from the spirit of the invention. It is therefore intended that the invention not be limited to the exact form and detail herein shown and described nor to anything less than the whole of the invention herein disclosed as hereinafter claimed.

What is claimed is:

1. A garment hanger comprising:

a body having first and second ends;

a hook member extending upwardly from the hanger body for suspending the hanger from a support location; and a pair of clip assemblies one at each of the first and second ends of the hanger body, each clip assembly including upper and lower clip members integrally formed with the hanger body, the upper clip member extending along an upper edge of the hanger body and the lower clip member extending along a lower edge of the hanger body, each of the upper and lower clip members having a resilient arm which is biased towards the hanger body for securing a garment in a space between the resilient arm and the hanger body, each clip assembly including an end clip member integrally formed with the hanger body, the upper and lower clip members being disposed between the end clip member and the hook member, the end clip member including an outer anchor arm and an inner resilient arm with an end clip slot formed therebetween, the outer anchor arm extending downwardly from the upper clip member, while the inner resilient arm extends upwardly from the lower clip member, the inner resilient arm being biased towards an inside contact surface of the outer anchor arm for securing a garment in the end clip slot, wherein the inner arm has a degree of inward flexing movement towards the hanger body for reception and securement of the garment in the end clip slot.

2. The garment hanger of claim 1, wherein the upper clip member includes a support arm integrally formed with the hanger body, the support arm extending from one of the ends of the hanger body toward the hook member, the resilient arm of the upper clip member being integrally formed with the support arm such that the resilient arm extends in an opposite direction as the support arm and is disposed between the support arm and the hanger body.

3. The garment hanger of claim 1, wherein the lower clip member includes a support arm integrally formed with the hanger body, the support arm extending from one of the ends of the hanger body toward the hook member, the resilient arm of the upper clip member being integrally formed with the support arm such that the resilient arm extends in an opposite direction as the support arm and is disposed between the support arm and the hanger body.

4. The garment hanger of claim 2, wherein the resilient arm of the upper clip member has a rounded end where the resilient arm joins the support arm.

5. The garment hanger of claim 3, wherein the resilient arm of the lower clip member has a rounded end where the resilient arm joins the support arm.

6. The garment hanger of claim 2, wherein the resilient arm and the support arm of the upper clip member form a unitary molded structure.

7. The garment hanger claim 3, wherein the resilient arm and the support arm of the lower clip member form a unitary molded member.

8. The garment hanger of claim 1, wherein the resilient arms of the upper and lower clip members have one or more ribs formed thereon facing the hanger body.

9. The garment hanger of claim 2, wherein the outer anchor arm of the end clip member is joined at one end to the support arm of the upper clip member, an entrance to the end clip slot being formed between the other end of the outer anchor arm and the lower clip member.

10. The garment hanger of claim 1, wherein the inner resilient arm has a clamping surface which faces an inner contact surface of the outer anchor arm, at least one of the clamping surface and the inner contact surface including one or more ribs formed thereon.

11. The garment hanger of claim 1, wherein the hanger body, the hook portion, and the clip assemblies are formed as a single molded member.

12. A garment hanger comprising:

a body having two ends;

a hook member extending upwardly from the hanger body for suspending the hanger from a support location; and a pair of clip assemblies, one clip assembly located at each end of the hanger body, each clip assembly having upper and lower clip members, each of the upper and lower clip members including integral first and second sections, the first section being integrally formed with one end of the hanger body and extending inwardly towards the hook member, the second section being joined to an innermost end of the first section and extending in an opposite direction to the first section such that the second section lies between the first section and the hanger body, the second section being biased towards the hanger body for securing a garment between the second section and the hanger body, the clip assembly further including an end clip member having an outer anchor arm and an inner resilient arm that is biased towards an inner contact surface of the outer anchor arm, the resilient inner arm being integrally formed with the first section of the lower clip member and extending substantially vertically upwards towards the upper clip member, the outer anchor arm being integrally formed with the first section of the upper clip member and extending substantially vertically downwards towards the lower clip member, the end clip member having a garment receiving slot between the outer anchor arm and the resilient inner arm, at least a portion of the resilient inner arm being spaced from the hanger body to permit a flexing movement of the resilient inner arm when a force is applied thereto.

13. The garment hanger of claim 12, wherein the first section of the upper and lower clip members comprises a support arm and the second section of the upper and lower clip member comprises a biased resilient arm.

14. The garment hanger of claim 12, wherein a channel is formed between a length of the resilient inner arm which terminates at a distal end thereof and an end wall of the hanger body.

15. The garment hanger of claim 12, wherein surfaces of the second sections that face the hanger body have at least one rib formed thereon.

16. A garment hanger comprising:

a body having two ends;

a hook member extending upwardly from the hanger body for suspending the hanger from a support location; and a pair of clip assemblies, one clip assembly located at each end of the hanger body, each clip assembly having:

a first horizontal clip member extending along a length of the hanger body, the first horizontal clip member having a first arm biased towards one of an upper surface and a lower surface of the hanger body for securing a garment between the first arm and the respective surface; and a vertical clip member including an outer anchor arm and a resilient inner arm biased towards an inner contact surface of the outer anchor arm, the resilient inner arm and the outer anchor arm defining an end slot for securing a garment, the resilient inner arm having a range of movement to accommodate insertion of the garment in to the end slot, wherein the resilient inner arm is flexible both towards and away from the body and the outer anchor arm at least flexes in a direction away from the resilient inner arm.

17. The garment hanger of claim 16, wherein the inner arm and the outer anchor arm are both flexible members each having a range of motion.

18. The garment hanger of claim 16, wherein each clip assembly further includes:

a second horizontal clip member extending along a length of the hanger body, the second horizontal clip member being opposite the first horizontal clip member, the second horizontal clip member having a second arm biased towards the other of the upper and lower surfaces of the hanger body for securing a garment between the second arm and the other surface.

19. The garment hanger of claim 16, wherein the resilient inner arm is integrally connected to one of the first and second horizontal clip members and the outer arm is integrally connected to the other of the first and second horizontal clip members.

20. The garment hanger of claim 16, wherein the first horizontal clip member further includes a first support arm having a first end and a second end, the first end being integrally connected to one end of the hanger body while the second end is integrally connected to the first biased arm, the first biased arm extending from the second end towards the first end such that the first biased arm is disposed underneath the first support arm.

21. The garment hanger of claim 16, wherein the second horizontal clip member further includes a second support arm having a first end and a second end, the first end being integrally connected to one end of the hanger body while the second end is integrally connected to the second biased arm, the second biased arm extending from the second end towards the second end such that second biased arm is disposed underneath the second support arm.

22. The garment hanger of claim 16, wherein the first biased arm and the upper surface of the hanger body define a first horizontal garment receiving slot and the second biased arm and the lower surface of the hanger body define a second horizontal garment receiving slot, the end slot being a vertical slot that is substantially perpendicular oriented relative to the first and second horizontal slots.

23. The garment hanger of claim 16, wherein the vertical clip member is an outermost clip member along the hanger body with respect to the hook member.

24. The garment hanger of claim 16, wherein the resilient inner arm has a greater resiliency than the outer anchor arm.

25. A garment hanger comprising:

a body having two ends;

a hook member extending upwardly from the hanger body for suspending the hanger from a support location; and a pair of clip assemblies, one clip assembly located at each end of the hanger body, each clip assembly having:

a vertical clip member including an outer anchor arm and a resilient inner arm biased towards an inner contact surface of the outer anchor arm, the resilient inner arm and the outer anchor arm defining an end slot for securing a garment, the inner arm and outer anchor arm each being a flexible member having a range of movement to accommodate insertion of the garment in to the end slot, wherein the resilient inner arm is flexible both towards and away from the body and the outer anchor arm at least flexes in a direction away from the resilient inner arm.

* * * * *